US005495218A

United States Patent [19]

Erb et al.

[11] Patent Number: 5,495,218

[45] Date of Patent: Feb. 27, 1996

[54] MICROWAVE WAVEGUIDE SEAL ASSEMBLY

[75] Inventors: Tom L. Erb, Austin; Michael H. Fesler, Round Rock; Hugh L. Perry, III, Austin, all of Tex.

[73] Assignee: Thermo Instrument Controls Inc., Waltham, Mass.

[21] Appl. No.: 230,387

[22] Filed: Apr. 20, 1994

[51] Int. Cl.[6] ..... H01P 1/08; H01P 5/00

[52] U.S. Cl. ..... 333/248; 333/252; 333/254

[58] Field of Search ..... 333/239, 242, 333/248, 252, 254, 230

[56] References Cited

U.S. PATENT DOCUMENTS

| | | | |
|---|---|---|---|
| 2,775,760 | 12/1956 | Brown et al. | 333/252 X |
| 2,783,295 | 2/1957 | Ewing | 333/254 X |
| 2,866,949 | 12/1958 | Tillotson . | |
| 2,869,086 | 1/1959 | Curtis et al. . | |
| 2,875,417 | 2/1959 | Griffith, Jr. | 333/260 X |
| 2,910,544 | 10/1959 | McNutt . | |
| 2,927,288 | 3/1960 | Ray | 333/252 |
| 2,966,643 | 12/1960 | Kohman et al. | 333/239 X |
| 2,981,906 | 4/1961 | Turner | 333/251 X |
| 3,019,281 | 1/1962 | Hartwell . | |
| 3,100,881 | 8/1963 | Edson | 333/252 X |
| 3,138,770 | 6/1964 | Baum et al. . | |
| 3,156,882 | 11/1964 | Bondley | 333/252 |
| 3,537,043 | 10/1970 | Smith | 333/239 |
| 3,577,105 | 5/1971 | Jones Jr. | 333/239 |
| 3,702,979 | 11/1972 | Fletcher et al. | 333/248 X |
| 3,828,244 | 8/1974 | Hyde | 333/230 X |
| 3,975,695 | 8/1976 | Hartman | 333/230 X |
| 4,032,868 | 6/1977 | Trudeau | 333/252 |
| 4,344,053 | 8/1982 | Anderson | 333/251 |
| 4,458,229 | 7/1984 | Landry et al. | 333/248 |
| 4,641,139 | 2/1987 | Edvardsson | 342/124 |
| 4,684,908 | 8/1987 | Kuntzmann et al. | 333/252 |
| 4,743,033 | 5/1988 | Guess . | |
| 5,115,218 | 5/1992 | Jean | 333/252 |
| 5,200,722 | 4/1993 | Wolf | 333/252 |

FOREIGN PATENT DOCUMENTS

| | | | |
|---|---|---|---|
| 635000 | 3/1950 | United Kingdom | 333/252 |

*Primary Examiner*—Paul Gensler
*Attorney, Agent, or Firm*—Fishman, Dionne & Cantor

[57] ABSTRACT

A microwave waveguide is presented which includes a gas tight seal which provides pressure isolation between two portions of the waveguide. In accordance with an important feature of this invention, an upper flange includes a threaded axial opening for receiving and retaining a threadably mated dielectric filling material. If the thread pitch is small relative to the signal wavelength, the threaded section has essentially the same electrical characteristics as a smooth waveguide. The resulting structure provides an economical and practical method of retaining a solid dielectric filling material in a waveguide against high pressure without changing the effective diameter of the waveguide. In accordance with another feature of this invention, a novel high pressure seal is provided between the upper and lower flanges in the area surrounding the threaded axial opening. This high pressure seal comprises the capture of a membrane or disk of soft material, preferably polytetrafluoroethylene (PTFE), in an essentially constant volume, closed cavity. The PTFE thus acts like a compressed fluid and provides for high pressure gas operation in hostile environmental conditions with reduced failure relative to prior art PTFE (or like materials) to metal sealing arrangements. In accordance with still another feature of this invention, the sealing membrane or disk described above is rendered thin (on the order of 0.002 to 0.020 inches) and includes outer dimensions which are larger than the outer dimensions of the waveguide. The disk or membrane is thin enough so as not to impact the electrical characteristics of the waveguide.

24 Claims, 4 Drawing Sheets

MICROWAVE WAVEGUIDE SEAL ASSEMBLY

BACKGROUND OF THE INVENTION

This invention relates generally to microwave guides and component parts therefore. More particularly, this invention relates to an improved microwave waveguide seal which maintains consistent and uniform electrical characteristics through a range of temperature, pressure and chemical environments.

While the present invention will be described in connection with a microwave level gauge for use in a container such as a rail car, it will be appreciated that the microwave waveguide and components therefore may be useful for a plurality of other applications including any application requiring waveguides and microwave components including, but not limited to, chemical processing vessels, waste storage tanks, ships and barges.

U.S. application Ser. No. 07/729,457 ('457) filed Jul. 17, 1991 now U.S. Pat. No. 5,305,237 (all of the contents of which are fully incorporated herein by reference thereto) discloses a method and apparatus for monitoring the level of flowable material contained in a vessel such as a tank. The level monitoring system of the '457 application includes a microwave seal assembly, a microwave transceiver assembly, a controller/processor assembly and a computer. The microwave transceiver assembly is adapted to the tank and the controller/processor assembly and the computer may be located locally or remotely. The seal assembly is permanently affixed to the tank in sealing relationship with an opening formed in a fitting that communicates with an upper portion of the tank. The transceiver assembly emits microwave signals through the seal toward the surface of the material and receives microwave signals reflected from the surface through the seal.

In a preferred embodiment of the seal assembly disclosed in the '457 application, a wave guide member is provided that extends into the tank and has an open upper end portion that is in facing relationship with the seal. The lower end portion of the wave guide member extends towards the bottom of the tank and is in fluid communication therewith. The seal assembly and the wave guide member are preferably welded together and secured as an assembly to the tank by a connecting ring that is welded to the wave guide member. In accordance with an alternative embodiment, the seal assembly communicates with the interior of the tank through a ball valve member. Other embodiments include the use of various types of antenna inside the tank.

Seal assemblies of the type described in the '457 application suffer from certain drawbacks and deficiencies. Serious problems have been encountered due to the need for sealing under high pressure and often in hostile environments. For example, it is problematic to form a gas tight seal in a dielectric filled waveguide. Conventional sealing techniques tend to disturb the electrical characteristics of the waveguide or are unable to provide the same temperature and chemical capabilities as the dielectric filling material. Similarly, it is difficult to retain a solid dielectric filling material in a waveguide against high pressure without changing the effective electrical diameter of the waveguide. While it is possible to retain a dielectric material in a waveguide by including small retaining features on the dielectric material, this scheme makes assembly complex. Since the features must be kept small so as not to create microwave reflections, it is difficult to design a system to retain high pressures when using a soft dielectric such as PTFE.

Still other problems are encountered in sealing disks or membrane made from PTFE or similarly soft materials for high pressure gas operation over a broad temperature range. Because of the problems of chemical compatibility with the contained material, conventional gaskets or "O" rings cannot be used. Gaskets or "O" rings made from or encapsulated with the same material as the membrane do not provide sufficient resiliency over the required temperature range. Moreover, a conventional PTFE to metal seal is not suitable as a high pressure seal because of the tendency of PTFE to cold flow. Once flow at high temperature relaxes the seal area, the contraction of the PTFE at low temperature can cause seal failure.

SUMMARY OF THE INVENTION:

The above-discussed and other problems and deficiencies of the prior art are overcome or alleviated by the improved microwave waveguide and associated waveguide components of the present invention. In accordance with the present invention, a waveguide transition is presented which provides conversion from a dielectric filled (solid) waveguide to untilled (gas, air, etc.) waveguide in such a fashion that the dielectric is retained in place under great pressure and the gases are prevented from leaking with these properties important properties being retained over a large range of temperature and under a variety of chemical environments. The retaining mechanism and seal are actually integral to the tilled waveguide which then transitions to untilled using a conventional transformer such as a stepped or tapered section.

In accordance with an important feature of this invention, the upper flange includes a threaded axial opening for receiving and retaining a threadably mated dielectric filling material. The pitch diameter of the threads are essentially equal to the desired waveguide diameter. If the thread pitch is small relative to the signal wavelength, the threaded section has essentially the same electrical characteristics as a smooth waveguide. Thus, the threaded section may be made as long as required to retain the pressures being exerted thereon. The resulting structure thus provides an economical and practical method of retaining a solid dielectric filling material in a waveguide against high pressure without changing the effective diameter of the waveguide.

In accordance with another feature of this invention, a novel high pressure seal is provided between the upper and lower flanges in the area surrounding the threaded axial opening. This high pressure seal comprises the capture of a membrane or disk of soft material, preferably PTFE, in an essentially constant volume, closed cavity. A resilient force may then be applied to the PTFE to accomplish a high pressure PTFE to metal seal. The PTFE cannot flow because the cavity is "closed" and therefore there is nowhere for flow to take place. The PTFE thus acts like a compressed fluid. This PTFE (or other soft material) to metal seal provides for high pressure gas operation over a broad temperature range and in hostile environmental conditions with reduced failure relative to prior art PTFE (or like materials) to metal sealing arrangements.

In accordance with still another feature of this invention, the sealing membrane or disk described above is rendered thin (on the order of 0.002 to 0.020 inches) and includes outer dimensions which are beyond the outer dimensions of the waveguide. The disk or membrane is thin enough so as not to impact (or substantially impact) the electrical characteristics of the waveguide. The membrane is made from a material (ceramic, plastic such as PTFE, etc.) with similar dielectric properties to the waveguide filling material. The actual sealing mechanism may be applied to the surface of the membrane away from the active area of the waveguide itself so as to have minimal effect of the electrical characteristics of the waveguide. Since the membrane is mechanically backed by solid dielectric material, a very thin membrane can seal very high pressures and therefore provide a gas tight seal for the dielectric filled waveguide.

The above-described and other features and advantages of the present invention will be appreciated from those skilled in the art from the following detailed description and drawings.

BRIEF DESCRIPTION OF THE DRAWINGS:

Referring now to the drawings wherein like elements are numbered alike in the several FIGURES.

Figure 1:
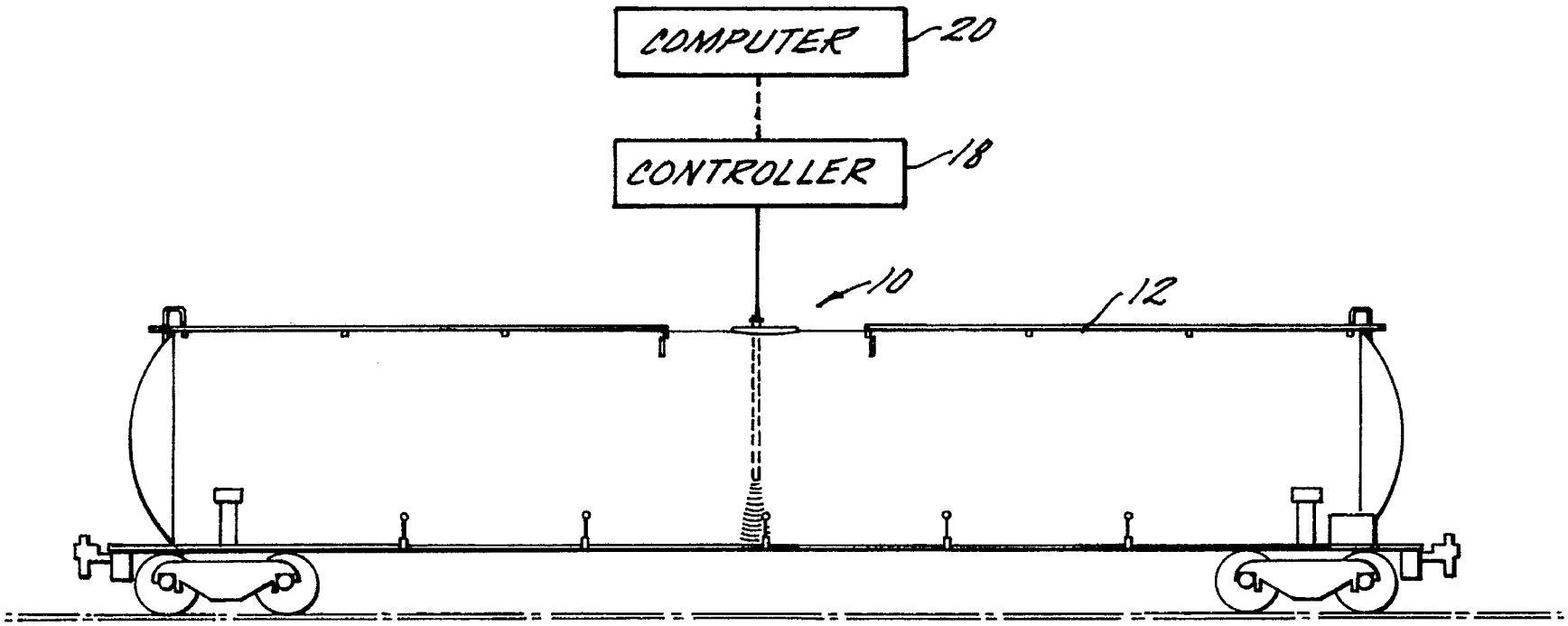
FIG. 1 is a schematic representation of a system for monitoring the level of flowable material in a tank in accordance with the present invention.

DESCRIPTION OF THE PREFERRED EMBODIMENT:

Referring first to FIG. 1, there is shown a schematic presentation of a system for monitoring the level and/or quantity of a flowable material or lading contained in a vessel or tank 12.

Figure 2:
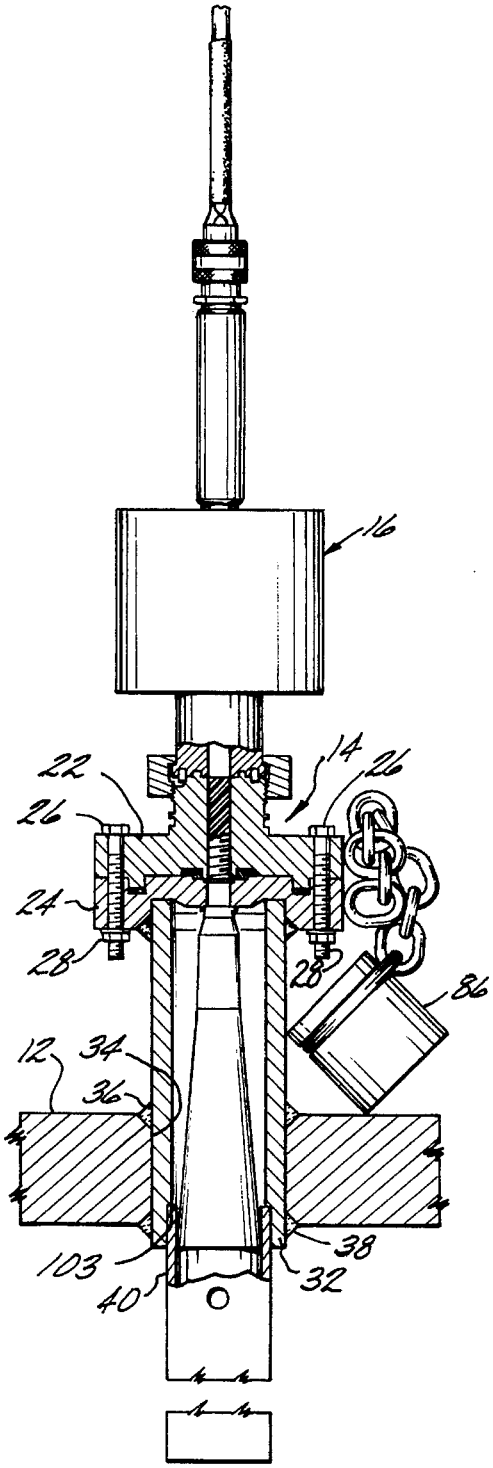
FIG. 2 is a cross-sectional elevation view through a portion of the tank of FIG. 1 which depicts the microwave level gage sensor installation in accordance with the present invention.

Referring to FIGS. 1 and 2, system 10 includes a seal assembly 14, a transceiver assembly 16, a controller/processor assembly 18, and a computer 20. Seal assembly 14 permits microwave signals to pass therethrough with a minimum amount of reflection and a minimum amount of attenuation. Seal assembly 14 has a novel construction and includes novel components, all of which will be described in detail hereinafter.

A transceiver assembly 16 is attached to the seal assembly 14 in a manner that will be further discussed hereinbelow. Transceiver assembly 16 is described in more detail in the '457 application and reference should be made thereto for further explanation.

Similarly, the controller/processor assembly 18 and computer 20 are described in detail in the '457 application and reference should be made thereto for additional understanding thereof.

Referring to FIGS. 2–9, seal assembly 14 comprises an upper flange 22 which is engagable to a lower flange 24 by a plurality of bolts 26 and nuts 28. Lower flange 24 includes a cylindrical recess 30 for receiving a tubular waveguide extension 32. Waveguide extension 32 is provided through a nozzle flange or other opening 34 on tank 12. It will be appreciated that waveguide extension 32 is welded or otherwise attached at points 36 and 38 to nozzle flange 34. Waveguide 40 is attached to waveguide extension 32 along circumferential groove 103 for communication with the interior of the chamber which in this case is the tank 12.

Figure 11:
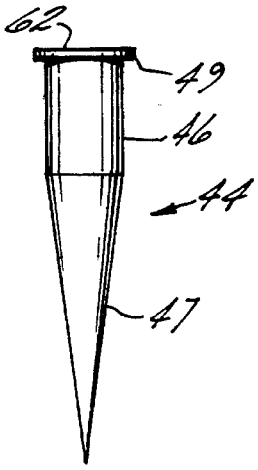
FIG. 11 is a front elevation view of a dielectric transition piece.
Figure 9:
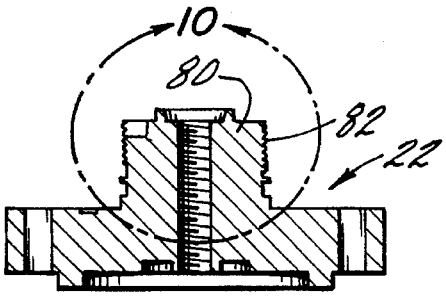
FIG. 9 is an enlarged cross-sectional view of the upper flange.
Figure 10:
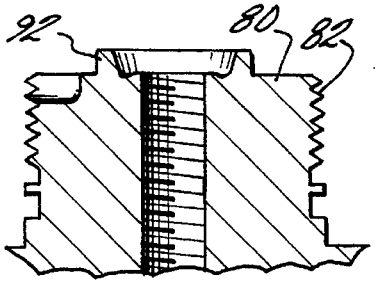
FIG. 10 is an enlarged view of the upper portion of the upper flange identified by the circled line 10 in FIG. 9.

Lower flange 24 also includes a central axial opening 42 which receives a dielectric transition piece 44 (best shown in FIG. 11). Dielectric transition piece 44 includes a cylindrical upper portion 46 having a length substantially equal to the width of flange 24. Cylindrical section 46 terminates at a tapered section 47 which converges downwardly towards the tank. A flange 49 is located on the upper surface of cylindrical section 46 opposed from tapered section 47. Dielectric transition piece 44 is preferably of one piece construction and is composed of PTFE. An axially oriented transition horn 50 is provided within waveguide extension 32. Transition horn 50 has an upper diameter which surrounds and engages dielectric transition piece 44 and then diverges outwardly to a second outer diameter which is substantially equal to the inner diameter of waveguide 40.

Figure 3:
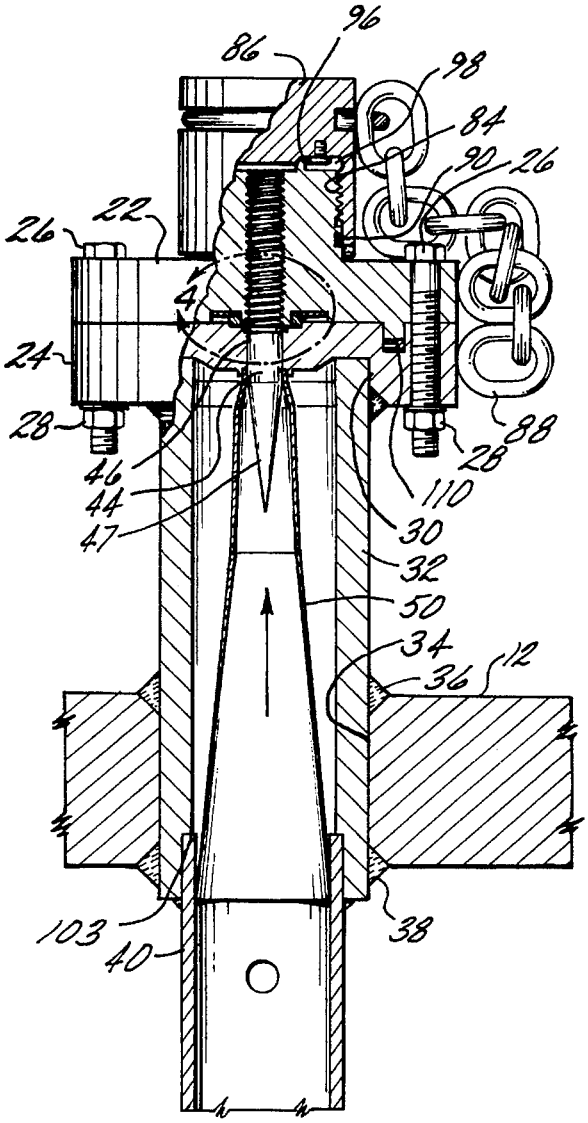
FIG. 3 is an enlarged cross-sectional view similar to FIG. 2 depicting the microwave waveguide of the present invention mounted on a tank with the microwave transceiver assembly removed.
Figure 4:
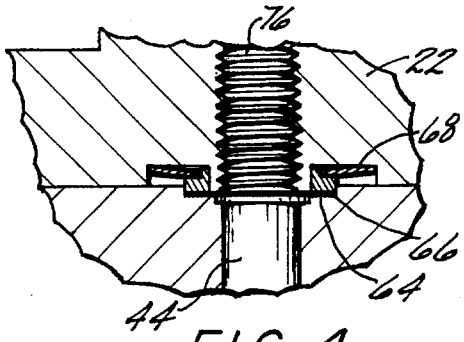
FIG. 4 is an enlarged cross-sectional elevation view of the sealing arrangement from the portion indicated by the circled line 4 in FIG. 3.
Figure 5:
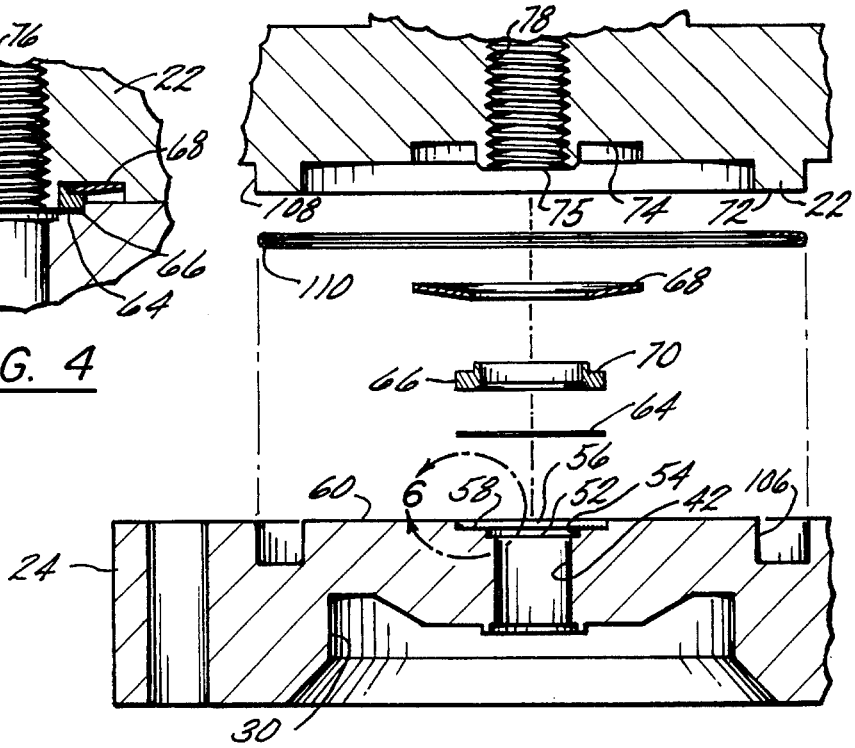
FIG. 5 is an exploded, cross-sectional elevation view depicting the sealing arrangement for the upper and lower flanges associated with the waveguide of the present invention.

As indicated by the arrow in FIG. 3, high pressure gases from the tank 12 will exert pressure in the direction indicated toward the dielectric transition piece 44. As a result, a reliable high pressure seal is required between the upper and lower flanges 22, 24. This seal is best seen in FIGS. 4 and 5. In accordance with the sealing arrangement, axial opening 42 in lower flange 24 is provided with a counter bore 52 having a diameter larger than the diameter of axial bore 42 defining a first shoulder 54. A second counter bore 56 defining a second shoulder 58 communicates with the upper surface 60 of lower flange 24. Counter bore 56 has a larger diameter than counter bore 52 which, as mentioned, has a larger diameter in turn than axial bore 42. Dielectric transition piece 44 is positioned through axial bore 42 such that the flange 49 is retained by shoulder 54. As a result, the surface of shoulder 58 is flush with the top surface 62 of dielectric transition piece 44. This results in a cavity being defined by shoulder 58, top surface 62 and the sidewalls of counter bore 56. Within that cavity is inserted a membrane seal 64.

Still referring to FIGS. 4 and 5, pressure ring 66 has an annular opening therethrough and has an L-shaped cross section defining a shoulder 70. Pressure ring 66 abuts the outer surface of membrane seal 64 and a Belleville washer or disc spring 68 is received by the shoulder 70 on pressure ring 66. The lower surface 72 of upper flange 22 includes an annular groove 74 which is sized to receive Belleville washer 68 and the upper portion of pressure ring 66 as shown in the assembled view of FIG. 4. As will be discussed in more detail hereinafter, the central area of groove 74 has a flat surface 75 defined by dielectric filling material 76. Thus, when flanges 22 and 24 are fastened, Belleville washer 68 exerts pressure on pressure ring 66 which in turn exerts pressure against membrane seal 64 within the cavity 56. It will be appreciated that the inner regions of membrane 64 will be tightly sandwiched between (1) surface 62 of dielectric transition piece 44 (FIG. 11), V-grooved surface 100 (see FIG. 6) of shoulder 58 (on the bottom); and (2) lower surface of pressure ring shoulder 70 and surface 75 of dielectric filing material 76 (on the top). This resultant structure transforms cavity 56 (interior to outer V-groove), into an essentially constant volume, closed cavity. The membrane seal 64, which is preferably formed from PTFE or a similar material, fills V-grooves 100, but cannot flow and therefore acts like a compressed fluid. It will be appreciated that the "closed" cavity or volume may have openings so long as the openings are small enough such that the PTFE or similar membrane seal material will not flow as a result of the applied force provided by the Belleville washer or other resilient spring mechanism 68.

Figure 6:
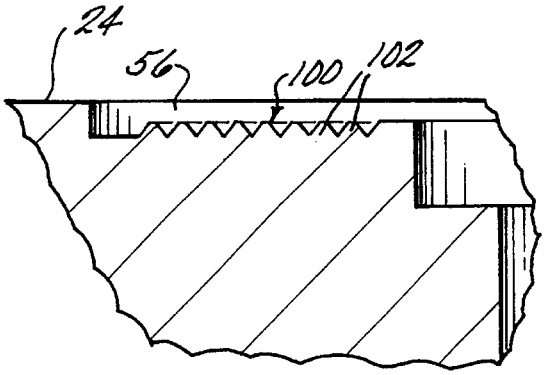
FIG. 6 is an enlarged cross-sectional view of the portion identified as detail 6 in FIG. 5.
Figure 7:
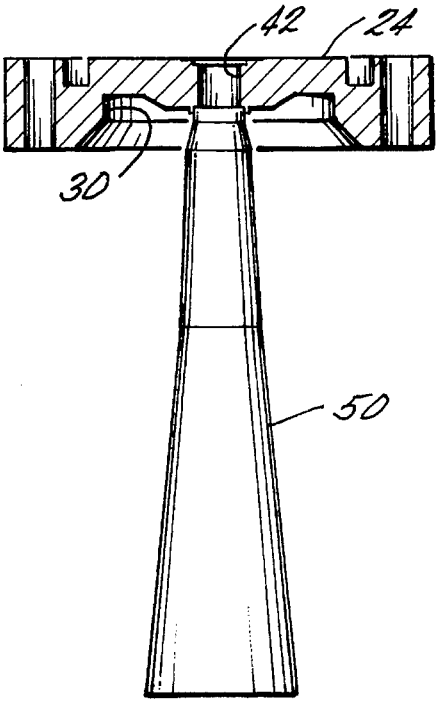
FIG. 7 is a cross-sectional elevation view of the lower flange assembled to the transition horn.
Figure 8:
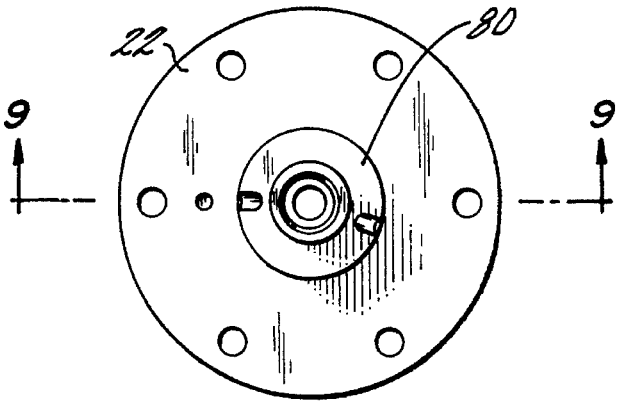
FIG. 8 is a top plan view of the lower flange of FIG. 9.

Referring to FIGS. 5–7, in a preferred embodiment, the annular region 56 surrounding axial bore 42 of lower flange 24 is provided with a series of concentric V-grooves 100. The V-grooves 100 are shown in detail in FIG. 6 and preferably comprise a plurality of teeth 102 separated by an angle of 60°. The purpose of V-grooves 100 is to contain a portion of membrane seal 64 pressed into V-grooves by pressure ring 66.

Preferably, the membrane seal 64 is extremely thin (0.002 to 0.020 inch) in the sealing area. This results in an absolute magnitude of shrinkage with temperature which is extremely small. Thus, the dynamic range requirement for the "spring" (Belleville washer 68) is quite small. The seal assembly described herein provides reliable sealing and high pressure gas operation over a broad temperature range. In addition, the seal prevents degradation by hostile environments of the membrane itself since the membrane is not exposed to the chamber.

In accordance with another feature of this invention, membrane seal 64 has outer dimensions (e.g., outer diameter) which extend beyond the outer dimensions of the waveguide (that is, beyond the outer diameters of dielectric filling material 76 and transformer 44). By outer dimensions, it is meant the cross-sectional dimension transverse to the signal path of the microwave signal through the waveguide. In addition, and as discussed above, the disk or membrane 64 is thin enough so as to not impact (or at least substantially impact or adversely affect) the electrical characteristics of the waveguide. Membrane 64 is composed of a material with similar dielectric properties to the waveguide filling material 76, to be discussed hereinafter. The actual sealing mechanism may be applied to the surface of the membrane away from the waveguide itself (e.g., along a path defined by the outer diameter of membrane seal 64) so as to have minimal effect on the electrical characteristics of the waveguide. Since the membrane is mechanically backed by solid dielectric material 76, a very thin membrane can seal very high pressures.

Referring to FIG. 5, flanges 22 and 24 also include a secondary seal means comprising a female annular groove 106 which receives a male annular extension 108. A metal seal 110 (preferably a C-shaped nickel plated Inconel 718 seal) is provided in groove 106 in sealing engagement with extension 108.

Upper flange 22 also includes an axial bore 78. Axial bore 78 receives the solid dielectric filling material 76. In accordance with an important feature of this invention, a retention system for retaining solid dielectric filling material 76 in axial bore 78 is provided such that high pressure exerted against dielectric filler 76 will not change the effective electrical diameter of the waveguide. In accordance with this retention system, dielectric material 76 comprises a threaded plug and mating threads are provided in axial bore 78 such that threaded plug threadably engages and mates with axial bore 78. The pitch diameter of the threads are essentially equal to the desired waveguide diameter. If a thread pitch is small relative to the signal wavelength, the threaded section has essentially the same electrical characteristics as a smooth waveguide. Thus, the threaded section may be made as long as required to retain the pressure.

A preferred embodiment of the present invention used 0.56 inch diameter waveguide with 11 threads per inch. The size is a function of frequency. For example, a configuration for two and a half times the frequency would use a 0.22 inch diameter waveguide and about 28 threads per inch.

The operation of microwave seal assembly 14 is essentially the same as the corresponding assembly 14 identified in the '457 application and therefore reference should be made thereto for such description. However, it will be appreciated that the microwave seal assembly 14 of the present invention includes important and significant structural distinctions which improve reliability from failure and improve electrical performance.

Finally, referring to FIGS. 2, 3 and 8–10, in one embodiment of this invention, the upper portion of upper flange 22 may comprise an extension 80 having outer threads 82 which threadably receive inner threads 84 from a cap 86 which is attached to upper flange 22 by chain 88. An O-ring seal 90 seals cap 86 to flange 22. In addition, an annular diverging ridge 92 mates with a correspondingly angled soft metallic seal 96 mounted in cap 86 as shown in FIG. 3. As a result, polarizing slots 98, are provided 120° apart.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A seal waveguide assembly comprising:

a first housing having a dielectric-filled microwave waveguide therein;

a second housing have a dielectric transition piece therein, said dielectric transition piece being positioned for microwave communication with said dielectric filled waveguide;

at least oral fastener for fastening said first housing to said second housing; and at least one seal for sealing said first housing to said second housing in the location between said waveguide and said transition piece said seal comprising an essentially constant volume closed cavity; a membrane seal in said cavity, said membrane seal being sandwiched between said waveguide and said transition piece; and resilient means for applying pressure to said membrane seal in said cavity wherein said membrane seal has the attributes of a compressed fluid.

2. The assembly of claim 1 wherein:

said membrane seal comprises polytetrafluoroethylene.

3. The assembly of claim 1 wherein:

said membrane seal comprises a disc having a thickness of about 0.002 to about 0.020 inches.

4. The assembly of claim 1 including:

a pressure ring between said membrane seal and said resilient means.

5. The assembly of claim 4 including:

an annular shoulder on said pressure ring; and wherein;

said resilient means comprises a disc spring seated on said annular shoulder.

6. The assembly of claim 5 including:

an annular groove in said first housing surrounding said waveguide, said disc spring also being seated in said annular groove.

7. The assembly of claim 6 wherein:

at least a portion of said cavity is defined by a bore in said second housing, said bore being in alignment with and surrounding said waveguide.

8. The assembly of claim 1 wherein said waveguide includes a cross-sectional dimension transverse to the path of microwaves passing therethrough and wherein said sealing means comprises:

a membrane seal having an outer dimension which is greater than the cross-sectional dimension of said waveguide.

9. The assembly of claim 8 wherein:

said membrane seal comprises polytetrafluoroethylene.

10. The assembly of claim 8 wherein:

said membrane seal comprises a disc having a thickness of about 0.002 to about 0.020 inches.

11. The assembly of claim 1 wherein said first housing includes a threaded opening therethrough and wherein:

said waveguide comprises a threaded plug of dielectric material, said threaded plug being threadably engagable to said threaded opening.

12. The assembly of claim 11 wherein:

said threading on said plug and said opening each have a pitch diameter corresponding to a selected diameter of said waveguide.

13. The assembly of claim 11 wherein:

said threading on said plug and said opening has a selected thread pitch relative to the wavelength of a signal passing through said waveguide wherein said waveguide has electrical characteristic analogous to a smooth waveguide.

14. The assembly of claim 1 wherein:

said dielectric transition piece comprises a cylindrical portion terminating at a converging tapered section.

15. The assembly of claim 14 wherein:

said first housing includes a threaded opening therethrough and wherein said waveguide comprises a threaded plug of dielectric material, said threaded plug being threadably engagable to said threaded opening.

16. The assembly of claim 14 including:

tubular waveguide extension means extending from said second housing;

transition horn means in said tubular waveguide extension means; and said tapered section of said transition piece being positioned within said transition horn means.

17. The assembly of claim 1 wherein:

said first and second housings comprise mateable flanges.

18. The assembly of claim 1 wherein said assembly is mounted through a wall in a chamber.

19. The assembly of claim 18 wherein:

said chamber comprises a tank.

20. In a seal waveguide assembly including a waveguide adapted for microwave communication with a transition piece, the improvement comprising:

sealing means between said waveguide and said transition piece, said sealing means comprising;

an essentially constant volume, closed cavity;

a membrane seal in said cavity said membrane seal comprising a disk having a thickness of about 0.002 to about 0.020 inches, said membrane seal being sandwiched between said waveguide and said transition piece; and resilient means for applying pressure to said membrane seal in said cavity wherein said membrane seal has the attributes of a compressed fluid.

21. The assembly of claim 20 including:

a pressure ring between said membrane seal and said resilient means.

22. The assembly of claim 21 including:

an annular shoulder on said pressure ring; and wherein;

said resilient means comprises a disc spring seated on said annular shoulder.

23. In a microwave waveguide positioned in a housing, the improvement comprising:

a threaded opening through the housing; and the waveguide comprising a threaded plug of dielectric material threadably engagable to said threaded opening wherein the threading on said plug and said opening has a selected thread pitch relative to the wavelength of a signal passing through said waveguide wherein said waveguide has electrical characteristics analogous to a smooth waveguide.

24. In a microwave waveguide positioned in a housing, the improvement comprising:

a threaded opening through the housing; and the waveguide comprising a threaded plug of dielectric material threadably engagable to said threaded opening wherein the threading on said plug and said opening each have a pitch diameter corresponding to a selected diameter of said waveguide.

* * * * *